US006239770B1

(12) United States Patent
Martesuo

(10) Patent No.: US 6,239,770 B1
(45) Date of Patent: May 29, 2001

(54) INSTRUMENT

(75) Inventor: Kai Markus Martesuo, Helsinki (FI)

(73) Assignee: Benemec Oy, Espoo (FI)

( * ) Notice: Subject to any disclaimer, the term of this patent is extended or adjusted under 35 U.S.C. 154(b) by 0 days.

(21) Appl. No.: 09/101,501

(22) PCT Filed: Jan. 13, 1997

(86) PCT No.: PCT/FI97/00014

§ 371 Date: Dec. 3, 1998

§ 102(e) Date: Dec. 3, 1998

(87) PCT Pub. No.: WO97/25702

PCT Pub. Date: Jul. 17, 1997

(51) Int. Cl.[7] ..... G09G 5/00

(52) U.S. Cl. ..... 345/4; 345/7; 345/8; 345/9; 345/87; 345/905; 359/630

(58) Field of Search ..... 345/4, 87, 905, 345/7, 8, 9; 359/630

(56) References Cited

U.S. PATENT DOCUMENTS 5,033,818 7/1991 Barr .
5,258,785 11/1993 Dawkins .
5,301,668 4/1994 Hales .
5,619,373 * 4/1997 Meyerhofer et al. ..... 359/482
5,856,819 * 1/1999 Vossler ..... 345/1

FOREIGN PATENT DOCUMENTS

95/28661 10/1995 (WO) .

* cited by examiner

*Primary Examiner*—Richard Hjerpe
*Assistant Examiner*—Jean Lesperance
(74) *Attorney, Agent, or Firm*—Browdy and Neimark

(57) ABSTRACT

The invention relates to an instrument adapted for difficult conditions of use, such as a diver's computer or the like, said instrument comprising a computer (2) as well as displaying device (6) for displaying to a user at least the control and/or output information related to said computer (2). The display (7) of said displaying device (6) is arranged in a casing (1) in such a manner that said display (7) can be clearly read from two essentially different directions (A and B). A first side of a structurally transparent display (7) is read directly (direction A) from the top of said display (7), and the opposite side is read essentially from the opposite side (direction B) of said casing through a special optical assembly (12) so that a mirror image is read of an image observed from the back side of said display (7).

14 Claims, 1 Drawing Sheet

INSTRUMENT

BACKGROUND OF THE INVENTION

1. Technical Field of the Invention

The present invention relates to an instrument as disclosed in the introductory portion of the appended claims, especially to a diver's computer or the like, said instrument comprising a processor or the like microprocessor device, as well a displaying device for presenting at least the processor's control and/or output data to a user. The invention further relates to a method for reading an instrument like a diver's computer or the like, wherein a display at said instrument is located in a casing having two different directions for reading said display.

Prior Art

Computers intended to be used e.g. by divers are know, said computers having processors for recording and processing, during the operation or thereafter, different parameters related to diving or the like, as well as devices for presenting such data to a user. As an example of such devices an apparatus according to Finnish Patent No. 91686 can be mentioned. Said apparatus is intended to be fastened to the user's wrist, the strap of his diver's mask or the like, said apparatus comprising a visual display and, suitably, means arranged separately for relaying said information to the user also in other ways.

Especially for a diver it is important that at least the most important data displayed by the diver's computer or the like device, as well as other information related to the operation, can be observed, during the use of said device, as easily as possible, and preferably directly in front of the user, by only looking e.g. at a special portion of the diver's mask.

U.S. Pat. No. 5,258,785 discloses a diver's computer having a display arranged in such a manner that it can be observed from the inside of a pair of diver's glasses or the like. U.S. Pat. No. 4,796,987 discloses an ordinary watch arranged in a corresponding manner.

The drawback of the devices according to said U.S. Patents is, however, that the information expressed by said devices can be seen only from a close distance and only through a pair of diver's glasses or a diver's mask. A complete diver's computer, however, can be used in a much more versatile manner, i.e. the programming operation of the device usually takes place prior to the actual diving, and, correspondingly, the retrieval of certain information stored in the computer during the diving operation is performed after said operation. Quite often the programming or the retrieval can be performed by an assistant or a supervisor, the diver himself still carrying his equipment.

Object and Summary of the Invention

In order to solve said problems the device and method according to the present invention have been developed. Thus, the present inventive device is characterized in the display of a displaying device being adapted in a casing in such a manner that said display can be clearly read from two essentially different directions. Correspondingly, the present inventive method is characterized in that a first side of a structurally transparent display is read directly from above said display and an opposite side of said display is read essentially from the opposite side of the casing through a special optical arrangement so that a mirror image of the image read from behind said display will be seen. Especially favorably the display of said device is as such arranged to be readable from both sides, especially so that said display is arranged in such a manner that a first side of said display shows data as an image to be read as a true image, i.e. from the right side, the same data constituting, when they are observed from the opposite side of said display, a mirror image of the observed true image. Preferably said display is relatively thin and typically transparent, in which case the display segments as such can be seen from both directions.

BRIEF DESCRIPTION OF THE DRAWINGS

The invention will now be described in more detail with reference to an embodiment disclosed in the appending drawing, wherein FIG. 1 discloses an instrument according to an embodiment of the invention as seen from above, a lid being presented as transparent for the sake of clarity, and FIG. 2 discloses the instrument of FIG. 1 as a sectional view from the side, said lid being open (where a closed position of said lid is presented in phantom).

DETAILED DESCRIPTION OF THE PREFERRED EMBODIMENT(S) OF THE INVENTION

Figure 1:
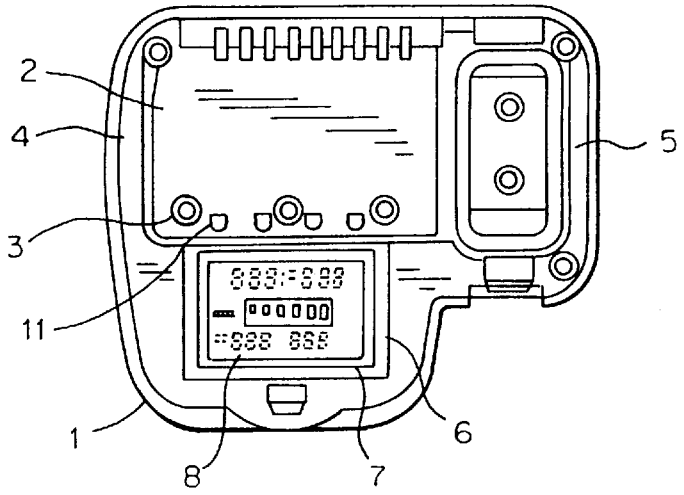

The device according to FIG. 1 comprises an essentially closed casing 1 comprising a microprocessor 2 and its control buttons 3. In the Figure a lid 4 of said device is shown to be transparent, but in another embodiment said lid may be opaque, for reasons to be discussed later on. Said casing 1 usually also comprises a battery casing 5. In the front portion of said device a displaying device 6 attached to said micro-processor 2 is shown, said displaying device comprising a display board or display 7 having display segments for the different information to be displayed, said segments generally being indicated by reference 8. At least said displaying device 6 shows the most important control and operational information data for said microprocessor so that the user is able to use the device and take benefit from it.

Figure 2:
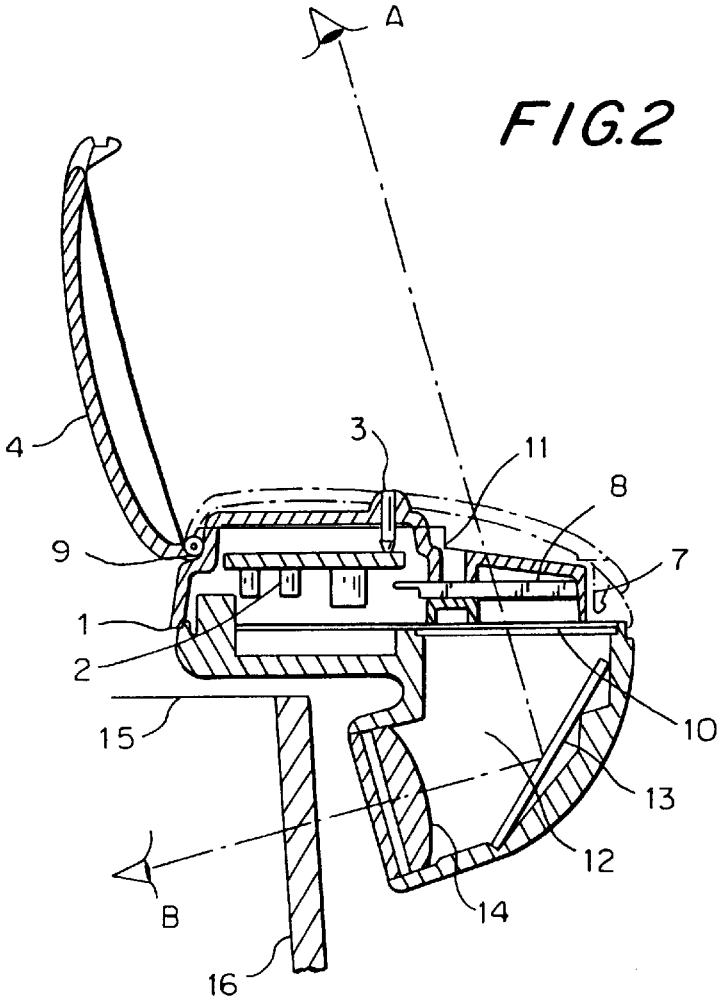

According to the disclosure of FIG. 2 the device favorably comprises a separate body 9 located in said casing 1, to which body the most essential components of the device are attached. From FIG. 2 it is evident that said display 7 according to the present invention is arranged in such a manner that it can be read from two different direction, i.e. in a first direction (direction A) from the top of said device, and in another essentially opposite direction (direction B) from the under side of the device. In the second situation the observation is made through a favorably transparent plate 10 directly at the back side of said display board 7.

In an alternative embodiment said display comprises separate parts in such a manner that different views actually can be seen from each directions (A and B), but according to an especially favorable embodiment of the invention said display 7 of said displaying device 6 actually comprises one single board which is at least partially transparent so that each display segment 8 can be seen from both sides. In this case the image seen from the back side of the display (direction B), or from below as shown in the Figure, is actually a mirror image of the image read from the top side of the display (direction A).

Favorably said displaying device 6 is a liquid crystal display or the like, wherein the actual display or frame board 7 holding the separate display segments 8 comprises a clear transparent material. In a favorable embodiment a cover 4 is made of a pale translucent material, in which case the bright display can be observed against a light background. According to a favorable embodiment the material of said lid 4 further comprises fluorescent agents in order to improve the background light properties.

As evident from FIG. 2 the first image of said display 7, i.e. the true one, can now be observed (direction A) from behind said lid 4, which preferably can be opened. If said lid is non-transparent it thus acts, in the closed position, especially effectively as a background for said display 7, when said display is observed from the opposite side i.e. from behind the display (direction B). Further, said display and/or said lid preferably comprises a separate illumination arrangement, like LED:s 11 shown in the Figures, which illumination may be automatically or manually activated. In the embodiment according to the Figures light from said LED:s 11 is directed against said lid 4 which makes a light background for said display 7.

Alternatively, said lid 4 as such may be essentially transparent, in which case the lid does not need to be opened for observation of the display from above (direction A) . By selecting the material of the lid 4 suitably and by a precise arrangement of the illumination one may also in this case obtain an arrangement wherein said display 6 is sufficiently distinguishable against the illuminated background when observed from below (direction B).

As can be further seen from FIG. 2 a separate optical arrangement 12 is usually attached to the device, said arrangement transforming said mirror image observed from behind said display 7 (direction B) into an image which can be read as a true one. Said arrangement 12 suitably comprises a mirror 13 as well as a lens assembly 14 for obtaining a close up focusation. Due to said mirror arrangement the image observed from behind said display (direction B) will be transformed so that the angle of view will change suitably about 90°.

The device is suitably mounted e.g. above a diver's mask 15 in such a manner that said lens assembly 14 will be located rather close to the mask's glass 16 on the outside thereof. During a the dive the user will be able to check the information given by the computer by directing his glance slightly towards the upper edge of the glass 16 of the mask 15, and the information displayed at the device's display 7 can now be seen as a true image and focused according to the reading distance.

Accordingly, he now himself, or an assistant outside, will be able to check, prior to or after the diving tour or in an emergency situation during the tour, the same display 7 from the upper side of the device, in which case the information also now can be seen as a true image and correctly focused. Thus, the computer can be programmed and information can be read without the need to put on the mask 15 only in order to see the information. In an emergency situation this feature can be a matter of life or death, and also in other situations the inventive arrangement essentially facilitates the use of the device and promotes the user's security.

Said microprocessor 2 is favorably a diver's computer for calculating and showing on said display 7 all such information which is important to the diver, like ascending and descending times, diving time, depth, water temperature, compass information etc. Said computer is favorably so arranged that a external device can be connected thereto for putting in and/or extracting data.

The device has been discussed above mainly with reference to diving, especially dicing in water, but it is clear that the same principles can equally well be utilized in smoke diving or in corresponding operations. The inventive arrangement may also be realized in other such cases where information should be displayed during an activity in a portable device which is easily and always ready for observation so that the same information is seen both in front of a user and from the outside. Such applications may comprise different military applications as well as applications related to mining or building work, where e.g. data related to directions and measurements or e.g. information regarding detonation times should be locally disclosed. In such applications the device may further be connected e.g. by radio to an external data source.

What is claimed is:

1. An instrument adapted for difficult conditions of use, said instrument comprising a computer (2) as well as a displaying device (6) for displaying to a user at least the control and/or output information related to said computer (2), c h a r a c t e r i z e d in said displaying device (6) being arranged in a casing (1) in such a manner that separate images displayed by a display (7) at each one of two opposite sides of said displaying device (6) can be clearly read from, respectively, two essentially differing directions (A and B).

2. An instrument as defined in claim 1, c h a r a c t e r i z e d in said display (7) being arranged for observation from both sides thereof.

3. An instrument as defined in claim 1, c h a r a c t e r i z e d in said display (7) being arranged in such a manner that a first side thereof displays said information as an image to be observed as a true image, and the same information forming, when observed from an opposite side of said display (7), a mirror image of said observed true image, wherein said display is thin and transparent, in which case the same display segments (8) can be seen from both directions (A and B).

4. An instrument as defined in of claim 3, c h a r a c t e r i z e d in a first true image at said display (7) being readable (direction A) behind a lid (4) which can be opened, said lid (4) acting as a background for said display (7) when a mirror image is read from the opposite side i.e. from behind (direction B) said display (7), wherein said lid favorably is made of a light translucent material which further comprises a fluorescent material.

5. An instrument as defined in claim 4, c h a r a c t e r i z e d in separate illumination means (11) being arranged for said display (7) and/or said lid (4).

6. An instrument as defined in any one of claim 3, c h a r a c t e r i z e d in said instrument further comprising a separate optical assembly (12), suitably a mirror and/or lens assembly (13, 14), for transforming the mirror image observed from behind said display (direction B) into a true image, so that an angle of observation will change about 90°.

7. An instrument as defined in claim 1, c h a r a c t e r i z e d in said displaying device (6) being a liquid crystal display having a body (7) made of a transparent material and holding said display segments (8).

8. An instrument as defined in claim 1, wherein the instrument is a diver's computer having a data processing means.

9. A method for reading an instrument wherein a display (7) in a displaying device (6) at said instrument is located in a casing (1) having two separate observation directions (A, B), said method comprising the steps of:

reading of a first side of structurally transparent display (7) directly (direction A) from a top of said display (7), and reading of an opposite side essentially from an opposite side (direction B) of said casing through a special optical assembly (12) so that a mirror image of the image observed from the back side of said display (7) is detected.

10. A method as defined in claim 9, further comprising the step of:

using a mirror and/or lens assembly (13, 14) as said optical assembly (12) so that an angle of observation will be refracted essentially 90°.

11. A method as defined in claim 9, characterized by further comprising the step of:

reading said image from said top side (direction A) of said display through a lid (4) which optionally can be opened, said lid (4) being used, in a closed position, as a suitably illuminatable light background for said image which is observed form a back side (direction B) of said display (7).

12. A method as defined in claim 9, wherein the instrument is a diver's computer having a data processing means.

13. An instrument adapted for difficult conditions of use, said instrument comprising a computer (2) as well as a displaying device (6) for displaying to a user at least the control and/or output information related to said computer (2), characterized in said displaying device 96) being arranged in a casing (1) in such a manner that separate images displayed by a display (7) at each one of two opposite sides of said displaying device (6) can be clearly read from, respectively, two essentially differing directions (A and B);

characterized in a first true image at said display (7) being readable (direction A) behind a lid (4) which can be opened, said lid (4) acting as a background for said display (7) when a mirror image is read from the opposite side i.e. from behind (direction B) said display (7), wherein said lid is made of a light translucent material which further comprises a fluorescent material.

14. A method for reading an instrument wherein a display (7) in a displaying device (6) at said instrument is located in a casing (1) having two separate observation directions (A, B), said method comprising the steps of:

reading of a first side of structurally transparent display (7) directly (direction A) from a top of said display (7), and reading of an opposite side essentially from an opposite side (direction B) of said casing through a special optical assembly (12) so that a mirror image of the image observed from the back side of said display (7) is detected;

reading said image from said top side (direction A) of said display through a lid (4) which optionally can be opened, said lid (4) being used, in a closed position, as a suitably illuminatable light background for said image which is observed form a back side (direction B) of said display (7).

* * * * *